US005687427A

United States Patent [19]

Lamattina et al.

[11] Patent Number: 5,687,427

[45] Date of Patent: Nov. 18, 1997

[54] INTEGRAL SAFETY HELMET FOR MOTORCYCLISTS, MOTORISTS, SPORTS DRIVERS INCLUDING AN IMPROVED VISOR

[75] Inventors: Carlo Lamattina, Lomagna; Cesare Landi, Milan, both of Italy

[73] Assignee: Cesare Landi S.r.l., Milan, Italy

[21] Appl. No.: 667,975

[22] Filed: Jun. 19, 1996

[30] Foreign Application Priority Data

Jun. 29, 1995 [IT] Italy ..... BG950032 U
Dec. 6, 1995 [IT] Italy ..... MI95A2577

[51] Int. Cl.[6] ..... A42B 3/22

[52] U.S. Cl. ..... 2/424

[58] Field of Search ..... 2/6.3, 6.4, 6.5, 2/6.7, 10, 424, 425

[56] References Cited

U.S. PATENT DOCUMENTS

| | | | |
|---|---|---|---|
| 2,270,238 | 1/1942 | Clarke et al. | 2/6.5 |
| 2,980,914 | 4/1961 | Heisig et al. | 2/6.5 |
| 3,879,761 | 4/1975 | Bothwell | 2/424 |
| 4,247,960 | 2/1981 | Nava | 2/424 |
| 5,014,366 | 5/1991 | Discipio, Sr. | 2/424 |
| 5,056,156 | 10/1991 | Kosmo et al. | 2/424 |

*Primary Examiner*—Michael A. Neas
*Attorney, Agent, or Firm*—Bucknam and Archer

[57] ABSTRACT

An integral type of safety helmet for motor-cyclist, motorists, sports drivers, including an improved visor has a hollow cap body including, on the front side, a window arrangement. At the window a visor is arranged, the visor being connected to a supporting element which extends on the top of the visor in a central top region of the front side of the cap body. This supporting element is pivoted to the cap body at a top region which is recessed from the visor, and can swing about a pivoting axis substantially perpendicular to the symmetry plane of the cap body, for opening or closing the visor.

6 Claims, 5 Drawing Sheets

2
6
5
12a
10
9a
8
18
4
7
14a
16a
13a
15a
11
17

4
18
9
9a
5
10
11
14a
12a
16a
13a
8
15a
6
17
2

INTEGRAL SAFETY HELMET FOR MOTORCYCLISTS, MOTORISTS, SPORTS DRIVERS INCLUDING AN IMPROVED VISOR

BACKGROUND OF THE INVENTION

The present invention relates to an integral or "jet" type of safety helmet for motorcyclists, motorists, sports drivers, including an improved visor.

Safety or crash helmets for motorcyclists, motorists, and sports drivers are already known. These prior helmets generally comprise a hollow body, having a substantially cap shape, having a bottom opening for allowing the helmet to be fitted to the user as well as a front vision window.

On this window is generally assembled a clear material visor, which is pivoted to the cap body of the helmet at two side opposite regions thereof, so that the visor can be lowered or raised depending on the user requirements.

The mentioned crash or integral helmets comprise moreover a chin supporting portion arranged at the bottom of the window, whereas in the so-called "jet" helmets, the windows merges with the bottom opening of the cap body of the helmet.

The visor of prior helmets is contoured and curved with the same curving raise as the helmet cap body in order to allow the visor to perfectly adhere to the helmet body in the lowered condition of said visor, to prevent air and water from penetrating the helmet.

The requirements of obtaining an optimum adhesion between the visor and helmet body causes technical and operating problems in obtaining a proper opening and closing movement of the visor since the visor, being laterally pivoted, is tangent to the helmet cross section.

Actually, such a tangent movement does not allow the visor to be recessed so as to be arranged flush with the helmet cap body profile.

Thus, in prior helmets of the above mentioned type, the visor will be flush with the helmet body at the bottom thereof, whereas said visor will not be flush at the top of the helmet since it would not be possible to properly easily open the visor.

Moreover, the connection of the visor to the helmet body is conventionally performed by a complex and expensive locking devices projecting from the cap contour and usually comprising pawl elements provided with a snap type of movement.

This coupling of the visor to the helmet body causes several drawbacks, such as a not perfect sealing with respect to a possible penetration of air and water, noises due to an aerodynamic turbulence effect, as well as a difficult operation of the visor in its opening and closing movements by the user.

Moreover, prior visors, being made of an impact resistant synthetic material are susceptible to be easily scratched thereby reducing the clearness or transparency properties of the visor. Moreover, prior visors are susceptible to be easily deformed and, accordingly, they must be operated with care by a user during the opening movement which movement, moreover, is frequently difficult to be performed.

Finally, for providing an optimum adhesion of the visor to the helmet body, it is frequently necessary to make visors which, as they are opened and/or closed, are susceptible to rub against the helmet so as to scratch it.

The clearness alteration that a conventional visor is subjected to will cause vision problem with a consequent reduction of the safety of the helmet, in particular during a night drive because of reflections generated by the above mentioned alterations.

SUMMARY OF THE INVENTION

Accordingly, the aim of the present invention is to overcome the above mentioned drawbacks by providing a safety helmet including a visor which, in the closing condition thereof, is perfectly adhering to the helmet body and which can be operated in a very simple and easy manner by the user.

Within the scope of the above mentioned aim, a main object of the present invention is to provide such a helmet-visor assembly which prevents air and water from penetrating the helmet body and which does not generate any aerodynamic noises even at a high driving speed.

Another object of the present invention is to provide such a helmet in which the visor does not interfere against the helmet body during the opening and/or closing of said visor, thereby providing an easier movement of the visor as well as a longer duration thereof.

Yet another object of the present invention is to provide such a helmet-visor assembly which has very good optical properties and which, in the case of impacts, does not damage the user.

According to one aspect of the present invention, the above mentioned aim and objects, as well as yet other objects, which will become more apparent hereinafter, are achieved by a safety helmet for motorcyclists, motorists, and sports drivers, or the like, of an integral or jet type, having an improved opening visor, comprising a hollow cap body having, on a front side thereof, a window, at said window a visor being arranged, characterized in that said visor is connected to a supporting element extending on the top of said visor at a central top region of the front side of said cap body, said supporting element being pivoted to said cap body at a top region thereof and recessed with respect to said visor, said supporting element being adapted to swing about a pivoting axis thereof, arranged substantially perpendicular to a symmetry plane of said cap body, for opening and closing said visor.

BRIEF DESCRIPTION OF THE DRAWINGS

Further characteristics and advantages of the helmet according to the present invention will become more apparent from the following detailed disclosure of a preferred, though not exclusive, embodiment of said helmet which is illustrated, by way of a merely indicative but not limitative example, in the figures of the accompanying drawings, where.

DESCRIPTION OF THE PREFERRED EMBODIMENTS

Figure 1:
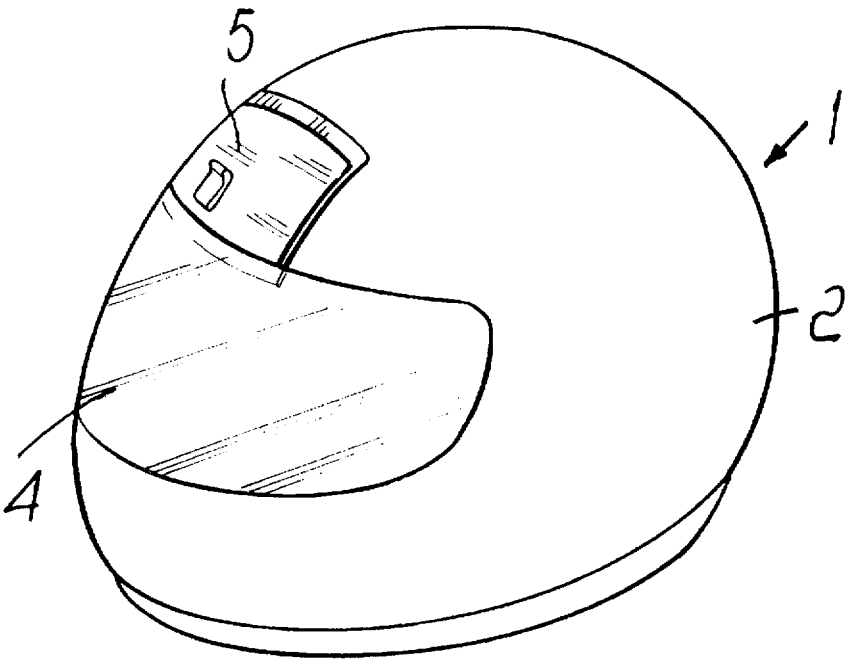
FIG. 1 is a perspective view illustrating the helmet according to the present invention, with the visor being in a closed condition.
Figure 2:
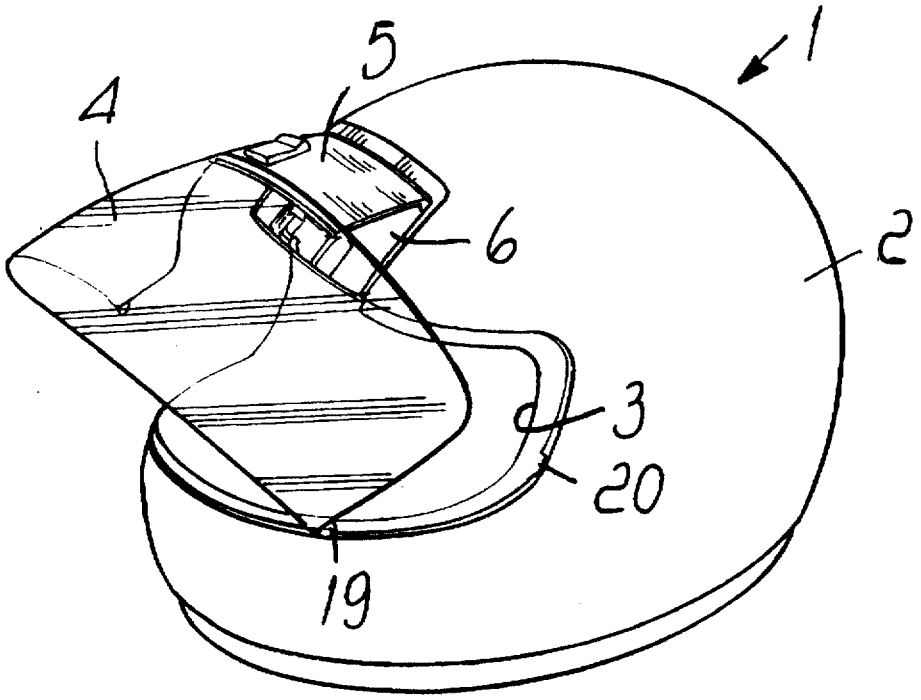
FIG. 2 is a further perspective view illustrating the helmet according to the present invention, with the visor being in an open condition.
Figure 3:
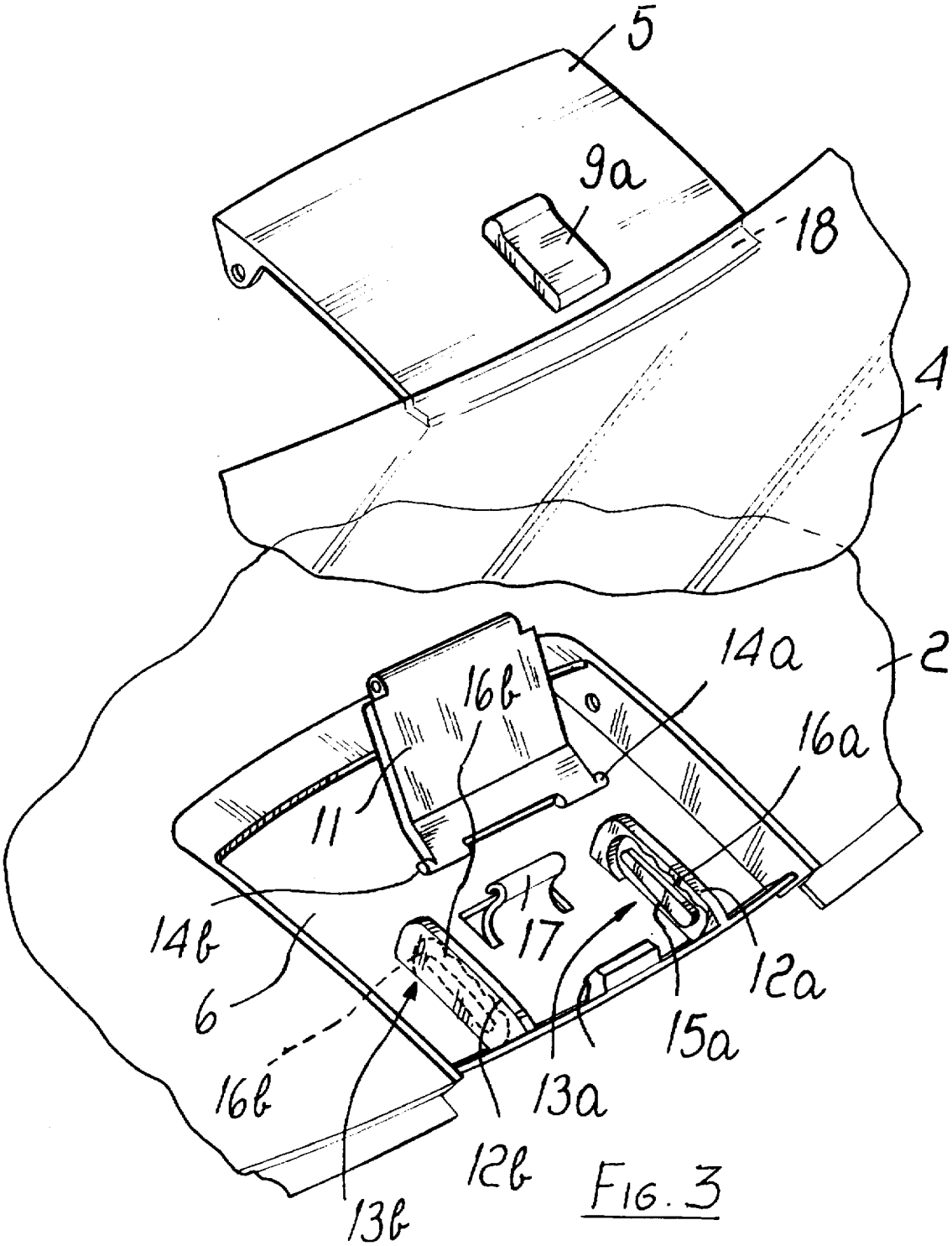
FIG. 3 is a further exploded perspective view illustrating the mechanism for opening and closing the visor.
Figure 4:
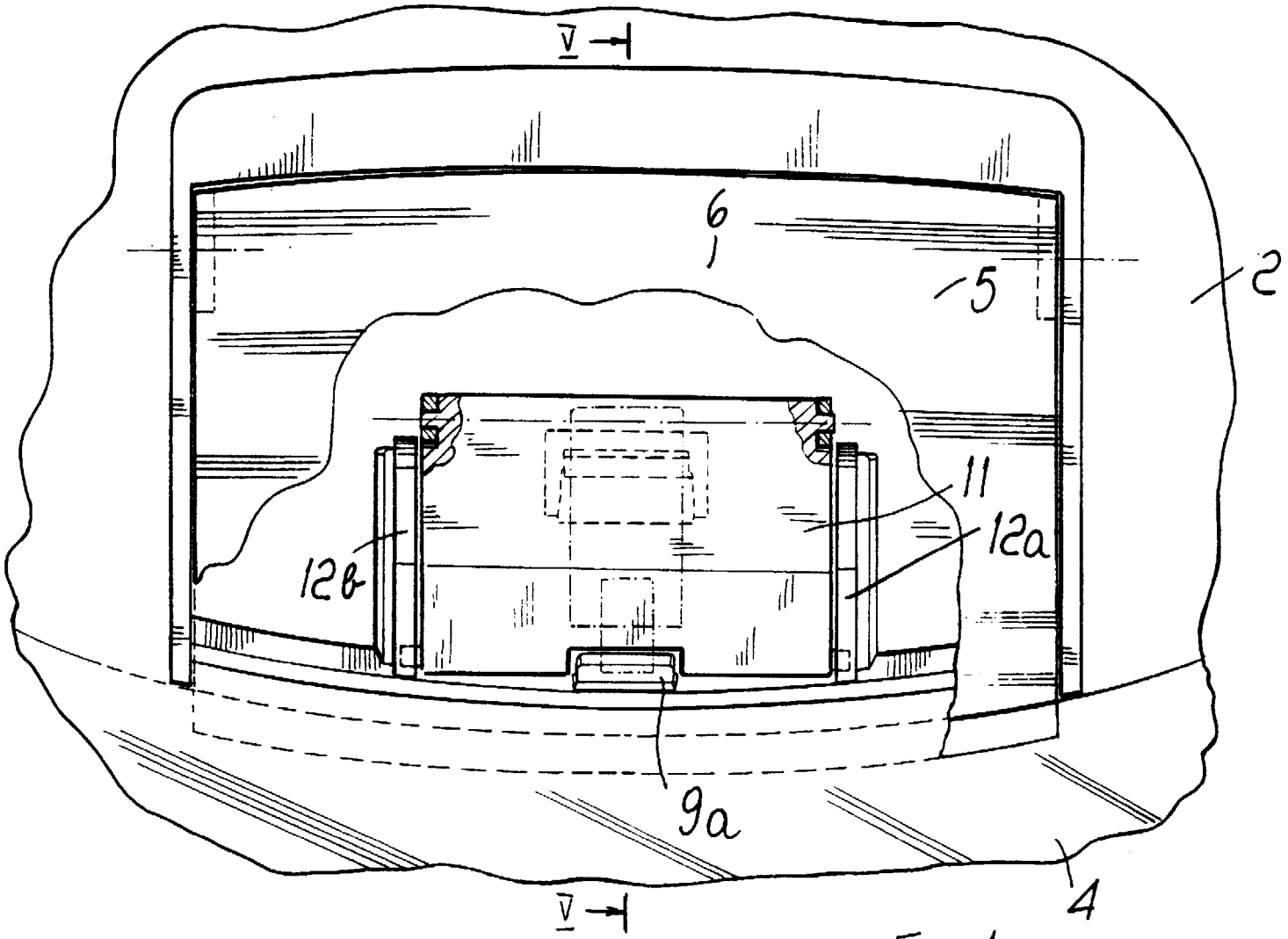
FIG. 4 is a top plan view illustrating the visor opening-closing mechanism with the visor supporting element shown in a partially broken-away manner.
Figure 5:
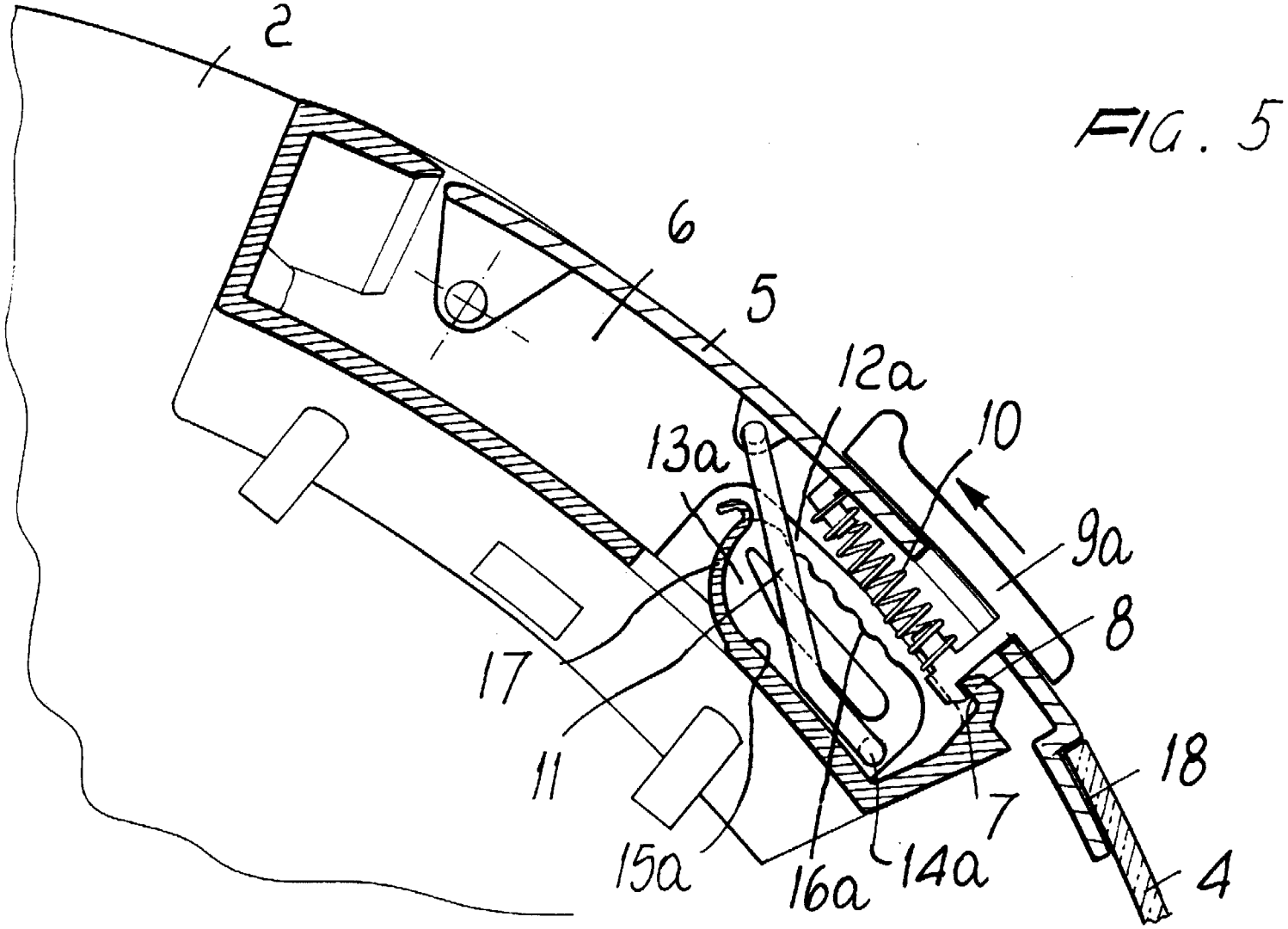
FIG. 5 is a cross sectional view of FIG. 4, substantially taken along the section line V—V, with the visor being in a closed condition.
Figure 6:
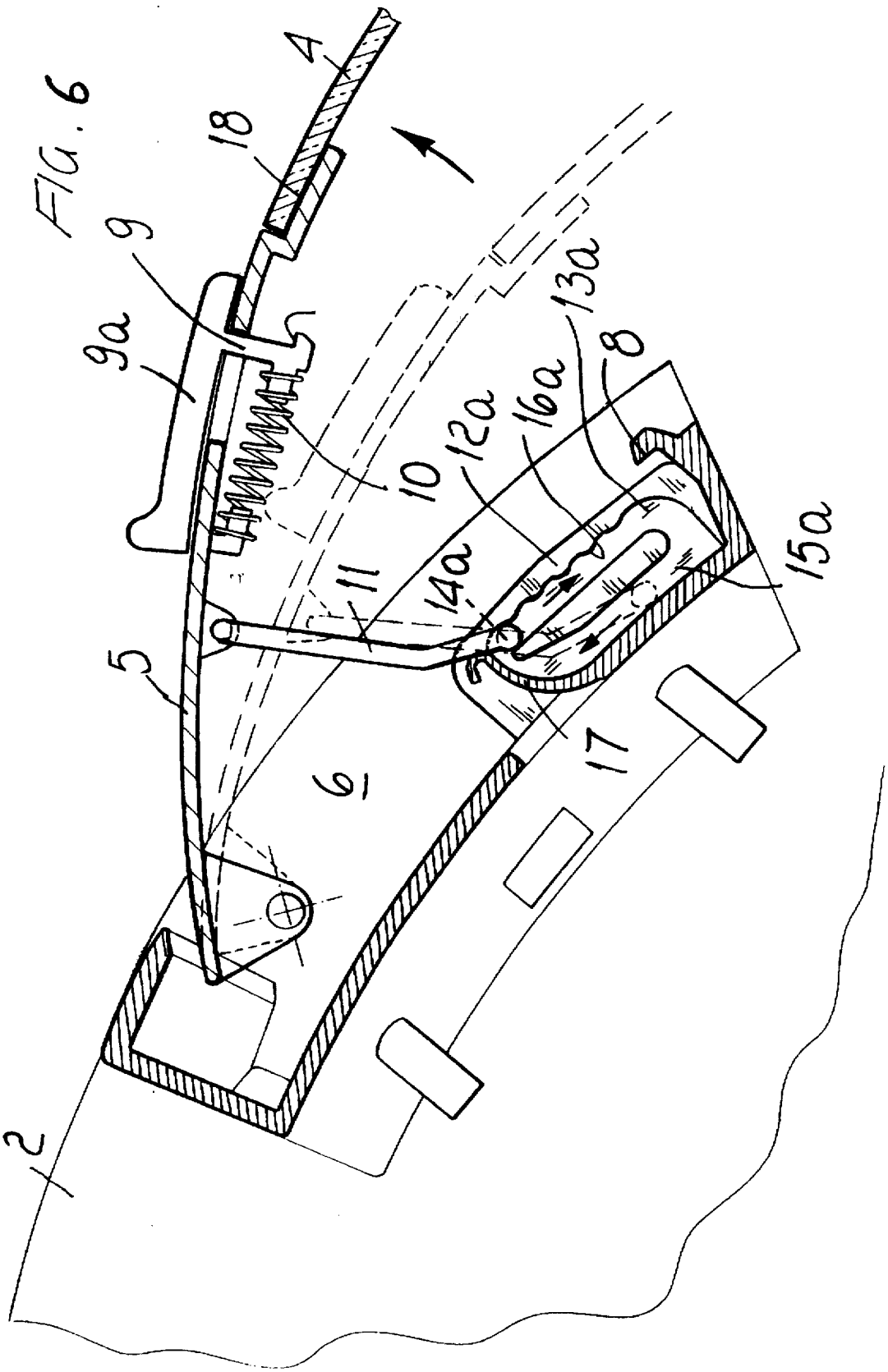
FIG. 6 is a further cross-sectional view similar to the cross-section view of FIG. 5, with the visor being shown in an open condition thereof.

With reference to the number references of the above mentioned figures, the helmet according to the present invention, which has been generally indicated by the reference number 1, comprises a hollow cap body 2, which is open at the bottom thereof, and which is provided, on the front thereof, with a window 3.

At the window 3 a visor 4 is arranged, said visor being connected, near the top edge portion thereof, to a supporting element 5 extending on the top of the visor 4 at a central region of the front top side of the body 2.

The supporting element 5 is articulated to the body 2 at a top region thereof recessed with respect to said visor 4 and being adapted to swing, about a pivot axis thereof, which axis is substantially perpendicular to the symmetry plane of the body 2 in order to allow said visor 4 to be opened or closed with respect to said window 3.

The outer surface of the supporting element 5 has preferably the same curved profile as that of the body 2 at the region thereof in which it is arranged and, on the bottom of the supporting element 5, in said body 2, a housing 6 is defined so that, with the visor in its closing condition, the supporting element 5 will not provide any interruptions through the outer profile or contour of the body 2.

The edge of the window 3 is advantageously recessed by a recessing amount corresponding to the thickness of the visor 4 so that, with the visor 4 being closed, said visor 4 will perfectly adhere to the edge of the window 3, without providing any interruptions with respect to the profile of the body 2.

The supporting element 5 is moreover provided with locking means for locking the visor 4 in its closing position, said locking means comprising a tooth element 7 mounted on the supporting element 5 and engaging with an abutment 8 defined by the front edge of the housing 6.

More specifically, the tooth element 7 is rigid with a slide 9 which is slidably mounted on said supporting element 5 and which projects, by a portion **9*a* thereof, on the outer side of the latter so that to be easily operated by an user. The slide 9, in particular, is biassed by a spring 10 which resists against the displacement of the slide 9 in the disengagement direction of the tooth element 7 from the abutment 8**.

Both the tooth element 7 and abutment can be provided with a lead-in beveled portion so as to allow the tooth element 7 to be snap engaged with the abutment 8 by simply pressing the supporting element 5 toward the body 2.

As shown, the supporting element 5 is articulated, by a middle portion thereof, to an end portion of an arm 11 which is connected, at the other end portion thereof, to the bottom of the housing 6 so as to define or limit the opening angle of the visor 4.

More specifically, the arm 11 is pivoted, with the top end portion thereof, to the supporting element 5 and, with the bottom end portion thereof it is engaged with means for restraining the supporting element 5 and accordingly the visor 4 at middle positions with respect to the positions corresponding to the visor opening and closing position.

These restraining means comprise a pair of blocks **12*a* and 12*b* which are coupled to the bottom of the housing 6 and each of which defines a path 13*a* and 13*b* for a peg 14*a*, 14*b* of the bottom end of the arm 11**.

The path **13*a*, 13*b* comprises an engagement portion 15*a*, 15*b* which is substantially smooth and therewith the peg 14*a*, 14*b* engages as the visor 4 is closed, and a further stepped portion or return portion 16*a*, 16*b* provided with steps which define stop regions for the peg 14*a*, 14*b* so as to lock the visor 4** at partial-opening positions during the swinging closing movement thereof.

Between the two blocks **12*a* and 12*b*, a resilient leg 17 extends from the bottom of the housing 6, said leg operating, by an upwardly directed force, on the arm 11 at the end of the visor opening movement in order to cause the pegs 14*a* and 14*b* to pass through the return portion 16*a* and 16*b*** during the subsequent visor closing movement.

As shown, the visor 4 is connected to the front side of the supporting element 5 at a recessed portion 18 allowing to hold the continuity of the contour of the body also in this region.

Moreover, the visor 4 is provided, at the bottom end portion thereof, with side tooth elements 19 which, as the visor 4 is closed, will be pressure engaged in seats 20 correspondingly provided on the recessed edge of the window 3, thereby stabilizing the visor in this closing position thereof.

The visor can be made of a synthetic or resinous material, such as, for example, of polycarbonate, or it can also be made of a safety glass material, of the laminated type, i.e. formed by two or more glass layers having a like shape and pattern, and overlapped onto one another so as to provide a substantially single-piece element which, if broken, would not present damaging problems for the user.

The user of the helmet according to the present invention will be self-evident from the above disclosure and, in particular, it should be apparent the operation mode of an user who, by operating by a single hand the slide 9 and the supporting element 5 or the visor 4, will open the visor 4 by causing it to swing about the pivot axis by which the supporting element 5 is pivoted to the body 2.

The user can hold the visor 4 in a fully open condition thereof, or in a partially open condition, by causing, during the visor closing movement, the pegs **14*a* and 14*b* to engage with the steps of the return portion 16*a* and 16*b*** as above disclosed.

In this connection it should be apparent that, owing to the particular coupling of the visor to the helmet body, the visor, in its maximum opened position, will provide a minimum impact angle against air.

From the above disclosure and from an observation of the several figures of the accompanying drawings, it should be apparent that the invention fully achieves the intended aim and objects.

In particular, the fact is to be pointed out that a visor-helmet assembly has been provided, the visor of which can be easily opened by a single hand, without causing any dangers for the user during this operation.

Moreover, the specifically designed visor supporting mechanism will provide an optimum sealing of the visor, while providing a continuous helmet contour, without any noises during the use of the helmet.

It should be also apparent that while the subject helmet has been disclosed and illustrated by way of an exemplary but not limitative embodiment thereof, the disclosed embodiment is susceptible to several modifications and variations all of which will come within the spirit and scope of the invention as claimed.

We claim:

1. A safety helmet for motorcyclists, motorists, and sports drivers of an integral type, having an opening visor, comprising a hollow cap body having, on a front side thereof, a window, at said window a visor being arranged, said visor being connected to a supporting element extending on said visor at a central top region of a front side of said cap body, said supporting element being pivoted to said cap body at a top region thereof and recessed with respect to said visor, said supporting element being adapted to swing about a pivoting axis thereof, arranged substantially perpendicular to a symmetry plane of said cap body, for opening and closing said visor, said window being provided with a recessed edge to receive therein an edge of said visor in a closing condition of said visor in which said visor edge is substantially continuous with the profile of said cap body, said supporting element being provided with locking means for locking said visor in a closing position thereof, said locking means comprising a tooth element mounted on said supporting element and adapted to be engaged with or disengaged from an abutment provided on a front side of said cap body, above said window, wherein said tooth element is rigid with a slide element associated with said supporting element and accessible from an outer side of said supporting element, said slide element sliding with respect to said supporting element for disengaging said tooth element from said abutment as counterbiassed by resilient means.

2. A helmet according to claim 1, in which said supporting element is articulated, by a middle portion thereof, to an arm limiting a swinging angle of said supporting element, wherein said arm is pivoted, at an end thereof, to said supporting element and, at another end thereof, engaging with restraining means for restraining said supporting element at middle positions with respect to positions thereof corresponding to the opening and closing positions of said visor.

3. A helmet according to claim 2, wherein said restraining means comprise at least a restraining block defining a path for a peg element coupled to said arm, said path including a substantially smooth path portion for allowing said supporting element to be swingably opened and a stepped return position, including a plurality of steps defining stop regions for stopping a closing swinging movement of said supporting element.

4. A helmet according to claim 3, wherein said helmet comprises moreover resilient means operating on said arm for automatically causing said peg to pass from said smooth portion to said stepped return portion at an end of a swinging opening movement of said supporting element.

5. A helmet according to claim 1, in which an end portion of said supporting element opposite to an end portion thereof articulated to said cap body, is coupled to said visor, wherein a coupling region of said supporting element to said visor is recessed in order to provide continuity of a profile of said helmet at said coupling region of said supporting element and said visor.

6. A helmet according to claim 1, wherein said visor is provided, near a bottom end portion thereof, with restraining tooth elements which can be pressure engaged in seats correspondingly formed on a recessed edge of said window.

* * * * *